US006435696B1

(12) United States Patent
Foottit

(10) Patent No.: US 6,435,696 B1
(45) Date of Patent: Aug. 20, 2002

(54) ELECTRIC LIGHT BULB HAVING A MIRROR, AND A STRIP LIGHT INCLUDING AT LEAST ONE SUCH BULB

(75) Inventor: Roberto Foottit, Boulogne (FR)

(73) Assignee: Rudolf Wendel, Garches (FR)

( * ) Notice: Subject to any disclaimer, the term of this patent is extended or adjusted under 35 U.S.C. 154(b) by 0 days.

(21) Appl. No.: 09/736,085

(22) Filed: Dec. 13, 2000

(30) Foreign Application Priority Data

Dec. 15, 1999 (FR) ..... 99 15812

(51) Int. Cl.[7] ..... F21V 21/00

(52) U.S. Cl. ..... 362/219; 362/217; 362/255; 362/240; 362/241; 362/247

(58) Field of Search ..... 362/219, 241, 362/237, 247, 249, 240, 217, 296, 255, 259, 341

(56) References Cited

U.S. PATENT DOCUMENTS 4,169,281 A * 9/1979 Brower ..... 362/241
4,302,794 A * 11/1981 Audesse et al. ..... 362/241
4,651,259 A * 3/1987 Wendel ..... 362/217
5,027,262 A * 6/1991 Freed ..... 362/249

* cited by examiner

*Primary Examiner*—Thomas M. Sember
(74) *Attorney, Agent, or Firm*—Levine & Mandelbaum

(57) ABSTRACT

The present invention relates to an electric light bulb having a longitudinal axis, a filament disposed at least approximately on said axis, and a glass having an outer peripheral face around the filament that is at least approximately circularly cylindrical about the axis. This outer peripheral face is secured directly to a mirror which it carries, the reflecting surface of the mirror being longitudinal and placed in contact with said outer peripheral face and having a cross-section which is selected and placed relative to the axis in such a manner as to concentrate the light emitted by the filament into a beam of predetermined orientation and flare angle. The invention is particularly applicable to making strip lights.

16 Claims, 1 Drawing Sheet

ELECTRIC LIGHT BULB HAVING A MIRROR, AND A STRIP LIGHT INCLUDING AT LEAST ONE SUCH BULB

The present invention relates to an electric light bulb of the type presenting a longitudinal axis and having a longitudinal filament disposed at least approximately on said axis and suitable for emitting light when it is electrically powered, and a glass enclosing the filament and presenting around it at least for the most part an outer peripheral face that is at least approximately circularly cylindrical about the axis.

Bulbs of this type, a non-limiting example of which is constituted by shuttle-shaped "festoon" bulbs, are generally circularly symmetrical about the axis and have two axial terminals for electrical connection to the filament at mutually opposite ends, and they emit light radially in all directions when the filament is powered with electricity. However, in numerous applications, it is pointless to emit light in some radial directions, so such bulbs are associated with a reflector or mirror which deflects the light emitted in this way to directions in which it is useful. This applies, for example, in applications of such bulbs to making lights for motor vehicles or indeed to making strip lights comprising a support in the form of a longitudinal strip together with a plurality of electric light bulbs of this type that are carried and held individually in longitudinal alignment by the support.

In such applications, the reflector or mirror is presently carried independently of the bulb, outside the bulb by a support which is nevertheless generally common, having the reflector or mirror generally secured thereto, and most often directly forming an integral portion thereof.

As a result, the average direction of light emission from the assembly constituted by the bulb and the reflector or mirror, whether by direct emission from the filament or by reflection of a portion of the light coming from the filament, is determined directly firstly by the shape of the reflector or mirror and by its positioning relative to the filament, and secondly by the orientation in which the support and with it the reflector are fixed to a counterpart which, for a vehicle light, is constituted by a piece of bodywork, and for a strip light is constituted by an element of a building front, an internal partition, or a wall of a piece of furniture, depending on what the strip light is used for.

This does not lead to any drawback in certain applications, such as vehicle signaling, given that in any event the support of the bulb and the reflector or mirror are generally integral portions of a light unit which is specially designed for each vehicle and which is suitable for enabling light to be emitted in directions that are determined once and for all relative to the vehicle. However, in other applications, such as making strip lights, directly securing or integrating the reflector or mirror to the support presents a drawback since the orientation in which the support is fixed determines the average direction in which light is emitted by the assembly constituted by the bulb(s) and the support. Unfortunately, it is sometimes difficult to reconcile the constraints on installing the support with desires or needs in terms of lighting; in addition, the average direction in which light is emitted, determined by the orientation of the support, is the same for all of the bulbs and there is no possibility of varying this average direction between zones that succeed one another longitudinally along the strip light, e.g. to emphasize certain items in relief on a building front; similarly, the light emitted in such conditions is in the form of a beam having a flare angle that is determined by the shape of the reflector or mirror, and, for example, it is not possible to increase this flare angle, whether only locally or over the entire length of the strip light.

The object of the present invention is to remedy those drawbacks and, to this end, in a first aspect, the present invention provides a bulb of the type specified in the introduction and characterized in that it further comprises, outside the glass, a mirror having a concave reflecting surface which is placed locally in contact with the glass and via which the mirror is directly secured to the outer peripheral face of the glass, which reflecting surface is defined by longitudinal generator lines and presents a cross-section different from the cross-section of the outer peripheral face of the glass, which section is selected and disposed relative to the axis in such a manner that the reflecting surface is tangential to the outer peripheral face of the glass along a common longitudinal generator line, and relative to the filament in such a manner that the reflecting surface concentrates the light emitted by the filament when it is electrically powered into a beam of predetermined orientation and flare angle.

Lamps are indeed already known in which the glass is metallized directly or carries a reflecting metal cap that is directly complementary to the glass, however the purpose is generally merely to prevent light from being emitted in certain directions, the lamp being otherwise associated with external optical means for shaping its emission of light into a beam of predetermined orientation and flare angle and in any event secured, sometimes adjustably, not to the bulb itself, but to a support for the bulb; that applies for example to certain bulbs used in projection apparatuses or indeed bulbs for indirect lighting devices. Under such circumstances, the metallization or the metal cap serves essentially as a mask and, although it makes it possible to avoid loss of light by reflecting the light emitted towards it from the filament of the bulb, it does not have a direct role in forming a beam. Bulbs are also known that contain an internal reflecting metal cup, and this applies for example to certain bulbs for motor vehicle headlights; in this case likewise, the idea is essentially to constitute a mask that prevents light being emitted in certain directions, and it is other means, in practice a reflector integrated in the bulb support or secured to said support, that serve to form the beam, generally in co-operation with portions in relief carried by a closure globe of the headlight.

In contrast, with a bulb of the present invention, it is the mirror that is secured directly to the glass of the bulb but that is shaped differently from said glass that determines the orientation and the flare angle of the beam.

Although a bulb of the invention can have other applications, this possibility is particularly advantageous when making strip lights that comprise a longitudinal support and a plurality of electric bulbs of the type specified in the introduction, and in a second aspect, the present invention extends to such strip lights insofar as at least one of said bulbs is a bulb of the invention.

Under such circumstances, the orientation and the flare angle of the beam are not determined, or at least not solely determined, by the orientation in which the support is installed, but can be selected at will, at least to a large extent, by choosing to use one or more bulbs of the present invention.

When in a preferred embodiment the support is suitable for carrying and holding individually at least one bulb of the invention in a plurality of orientations about its axis, which orientations are selected independently of the orientations of other bulbs around their axes, and this can be achieved by means of supports that are themselves known when the bulb of the invention is of the "festoon" type. When a plurality of bulbs of the invention are used on a common support, it is possible to orient all of the bulbs in the same manner, thereby obtaining a uniform direction of light emission while benefiting from the advantage of being able to select this direction in a manner that is largely independent of the orientation in which the support is installed. Nevertheless, in such an embodiment, it is also possible to orient individually bulbs of the invention distributed along the strip, in which case it is possible for example to modulate the direction of lighting as a function of the portions in relief to be illuminated, by orienting a certain number of adjacent bulbs in one zone of the strip light identically while orienting the bulbs in another zone thereof differently; it is then also possible to vary the orientation of the bulbs along their common support in systematic manner and thus, for a given flare angle of the beam emitted by each bulb, to increase the flare angle of the beam emitted by the bulbs considered together; thus, in order to satisfy various requirements, there is no need to use bulbs of the invention having mirrors shaped so as to correspond to emitted beams having different flare angles.

This gives rise to a large increase in the options made available by strip lights in terms of being adaptable to requirements.

Nevertheless, the transverse size of a bulb of the invention is not greatly increased by the presence of the mirror, so it remains compatible with the components of previously known strip lights, i.e. it can be mounted thereon to replace conventional bulbs which do not have their own mirrors.

In conventional manner, a strip light of the invention, particularly when it is intended for use outside, can include a transparent longitudinal tube coaxially surrounding the bulbs together with the support and suitable for being, at will, closed in leakproof manner or opened, in particular for the purpose of changing bulbs.

Various mirror shapes and various mirror positions relative to the filament of the bulb can be envisaged, depending on requirements.

When a parallel beam of light is to be emitted, a bulb of the invention is characterized in that the cross-section of the reflecting surface is parabolic and tangential to the cross-section of the outer peripheral face of the glass, in that its focus lies on the axis, and in that its directrix is situated at a distance from the axis that is equal to the outside diameter of the glass.

However, it should be observed that the filament does not necessarily coincide with the axis; in particular, numerous "festoon"-type bulbs have a filament that is wound helically around the axis so that even when the reflecting surface has a cross-section that is parabolic and accurately placed in the manner described above, the beam that is emitted by the assembly constituted by the bulb with its mirror when the filament is powered electrically will be only approximately parallel.

Thus, for a beam that provides a good approximation to being parallel, an acceptable embodiment of the bulb of the invention is characterized in that the cross-section of the reflecting surface is circular and tangential to the cross-section of the outer peripheral face of the glass, in that its center is placed on the outer cross-section of the glass, and in that its radius is equal to the outside diameter of the glass. This choice facilitates manufacture of the mirror considerably and consequently considerably facilitates manufacture of the bulb of the invention as a whole, since a mirror suitable for this embodiment can be obtained by a curving operation that is particularly simple to implement, starting from a sheet of suitable material, e.g. aluminum or stainless steel; naturally, such implementation of the mirror by curving a sheet can be adopted for a mirror having a different cross-section.

Preferably, the cross-section of the reflecting surface is symmetrical about a plane containing the axis, and/or the reflecting surface extends over an angle relative to the axis that is not greater than 180°, and that is preferably close to 180°, in such a manner respectively as to enable the bulb to be installed either way round on its support, particularly when the bulb forms part of a strip light, and to be able to benefit from a degree of directionality in the illumination obtained; nevertheless, it would not go beyond the present invention to give the reflecting surface shapes that are different.

The way in which the mirror is secured to the glass of the bulb can also be selected freely, providing it simultaneously preserves the reflecting power of the reflecting surface and withstands the operating temperatures of the bulb.

Preferably, the mirror is stuck to the outer peripheral face of the glass via its reflecting surface by means of adhesive that is transparent or translucent, and good results have been obtained in testing with a "festoon"-type bulb using a commercially available adhesive that is polymerizable by being exposed to ultraviolet radiation. This example is not limiting in any way, and in particular with bulbs that operate at higher temperatures the person skilled in the art is in a position to make the most appropriate selection for each circumstance; specifically, good results have been obtained during testing with a ceramic adhesive for use with halogen bulbs.

Other characteristics and advantages of the present invention appear from the following description relating to two embodiments of a bulb of the invention and to an embodiment of a strip light of the invention, and also to the accompanying drawing.

Figure 1:
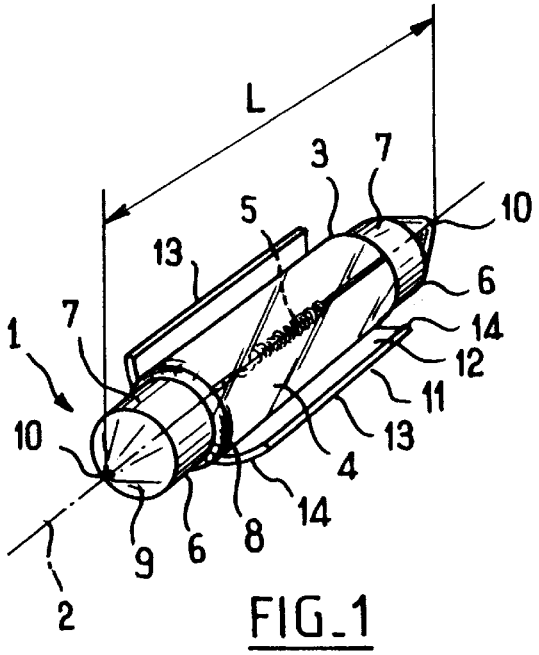
FIG. 1 is a perspective view of an electric light bulb of the invention of the "festoon" type.

Naturally, although the bulb of the invention that is selected for illustration and description purposes is of the "festoon" type, bulbs of numerous other types could, in accordance with the present invention, be fitted with an external mirror having a reflecting surface of a shape that is different from the outside shape of the glass of the bulb and that is placed locally in contact with said glass and that is secured directly thereto.

As shown by way of non-limiting example in the figures, the bulb 1 of the invention has a longitudinal axis 2 about which it is generally circularly symmetrical, in particular concerning its glass 3 which is generally in the form of a circular section tube about the axis 2, being defined in particular by an outer peripheral face 4 that is circularly cylindrical about said axis. Naturally, the term "glass" should be understood broadly as in expressions such as "lamp glass" or "glasses" which do not imply any limit as to the kind of material from which the "glass" is made. A longitudinal filament 5 is enclosed in leakproof manner inside the glass 3 and in this non-limiting example the general shape of the filament is that of a circular helix about the axis 2, having a diameter that is small compared with the diameter of the outer peripheral face 4 of the glass 3. To enable the filament 5 to be powered with electricity, the bulb 1 has two axial terminals 6 at respective longitudinal ends, i.e. disposed at opposite ends of the glass 3 along the axis 2. On the outside, each of the terminals 6 is defined in the immediate vicinity of its connection with the glass 3 by an outer peripheral face 7 that is circularly cylindrical about the axis 2, having a diameter that is slightly smaller than the diameter of the outer peripheral face 4 of the glass 3 and to which said face 7 is joined via a corresponding annular transverse shoulder 8 in the glass 3; at its longitudinal end distant from its connection with the shoulder 8, the face 7 of each terminal 6 connects to an external peripheral face 9 which is convex and circularly frustoconical about the axis 2 and terminates in a tip 10 lying on the axis 2 and pointing longitudinally away from the glass 3.

These characteristics of a "festoon"-type light bulb are well known themselves and do not require further description.

However, in a manner that is characteristic of the present invention, the outer peripheral face 4 carries a mirror 11 which is secured directly thereto, e.g. by means of a transparent or translucent adhesive that is polymerizable by being exposed to ultraviolet radiation, or an adhesive of the ceramic type. The mirror 11 is advantageously made as a single piece by stamping and curving a sheet of metal that has good reflecting properties when polished and that conserves its reflecting properties throughout the probable lifetime of a light bulb 1, specifically aluminum or stainless steel, for example.

More precisely, when developed flat the mirror 11 is rectangular in shape for example, and it is curved so as to present a continuous concave reflecting surface 12 defined by generator lines extending parallel to the axis 2, facing the outer peripheral face 4 of the glass 3, and coming partially into contact with said outer peripheral face 4 in particular in order to be secured thereto as mentioned above with adhesive in a respective zone, in which said contact takes place, and/or the immediate vicinity of said respective zone. This reflecting surface 12 is terminated by two longitudinal edges 13 of the mirror 11 and by two transverse edges 14 thereof, which edges 13 and 14 define the above-mentioned rectangular shape when the mirror 11 is developed flat; each transverse edge 14 is adjacent to a respective shoulder 8 of the glass 2, with the length of the mirror 11 as measured between these edges 14 being slightly shorter than the length of the glass 3 but longer than the length of the filament 5, which filament is centered not only transversely but also longitudinally inside the glass 3.

Figure 2:
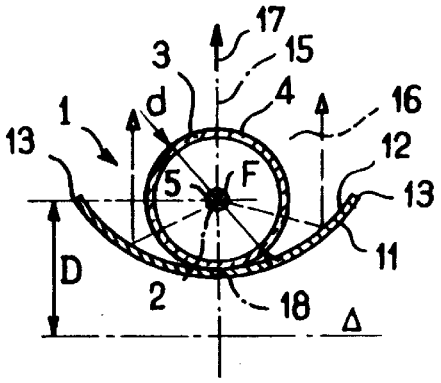
FIGS. 2 and 3 are current cross-section views of the bulb respectively for the reflecting surface having a cross-section that is parabolic and for the reflecting surface having a cross-section that is in the form of an arc of a circle.
Figure 3:
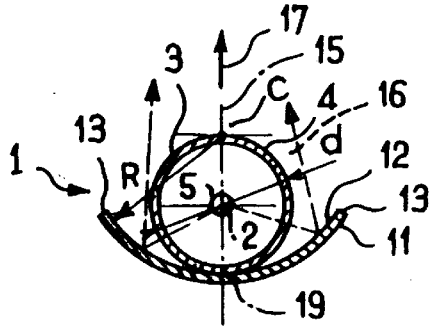

As can be seen in particular from FIGS. 2 and 3, the constant cross-section of the reflecting surface 12 of the mirror 11 and indeed of the mirror considered as a whole, is preferably symmetrical about a plane 15 including the axis 2, and relative to said axis 2 it presents an angular extent between its longitudinal edges 13 of not more than 180°, but preferably close to 180°.

This cross-section of the reflecting surface 12 is different from the cross-section of the outer peripheral face 4 of the glass 3, i.e. it is not circularly cylindrical about the axis 2 with the same diameter as the outer peripheral face 4 of the glass 3, and this cross-section is selected and located relative to the axis 2 and consequently relative to the filament 5 in such a manner that when the filament 5 is powered electrically the reflecting surface 12 concentrates the light coming therefrom into a beam 16 of predetermined orientation and flare angle.

By way of non-limiting examples, FIGS. 2 and 3 show two cross-sections of the reflecting surface 12 that are of shapes suitable for this purpose. In both cases, given the above-mentioned symmetry of the cross-section of the reflecting surface 12 about the plane 15, the average emission direction 17 of the beam 16 lies in the plane 15, going perpendicularly away from the axis 5.

In the embodiment shown in FIG. 2, the cross-section of the reflecting surface 12 is parabolic. The focus F of the parabola lies on the axis 5 and the directrix Δ of the parabola is situated at a distance D from the axis 5 which is equal to the outside diameter d of the glass 3, i.e. to the diameter of its outer peripheral face 4, such that the reflecting surface 12 is tangential to said outer peripheral face 5 along a common generator line 18 parallel to the axis 5 and situated in the plane 15 between the axis 5 and the directrix Δ and at equal distances from the axis 5 and the directrix Δ. In this case, the mirror 11 is secured to the glass 3 by adhesive along said generator line 18, and in practice also generally in the immediate vicinity of said generator line 18 on either side thereof, between the reflecting surface 12 and the outer peripheral face 4 of the glass 3.

In the embodiment shown in FIG. 3, the cross-section of the reflecting surface 12 is circular; its center C is situated on the outer cross-section of the glass 3, i.e. on the face 4 thereof, and its radius R is equal to the diameter d of the outer cross-section of the glass 3, i.e. the diameter of the outer peripheral face 4 thereof, such that the reflecting surface 12 is tangential to said outer peripheral face 4 along a common generator line 19 parallel to the axis 5 and situated at one of the intersections between the plane 15 and the outer peripheral face 4 of the glass 3, with the center C being situated at the other intersection of said plane 15 with said outer peripheral face 4. In this case, the mirror 11 is secured to the glass 3 by adhesive along the generator line 19 and in practice generally in the immediate vicinity of said generator line 19 on either side thereof between the reflecting surface 12 and the outer peripheral face 4 of the glass 3.

In both of these embodiments, the beam 16 emitted by reflection on the reflecting surface 12 when the filament 5 is electrically powered can be considered to a good approximation as being a parallel beam, given the shape of the filament 5 and inevitable dimensional tolerances. In cross-section, the flare angle of the beam is determined by the transverse dimension of the reflecting surface 12, and in particular by the distance (no reference) between the longitudinally-extended edges 13 of the mirror 11.

Naturally, other shapes could be adopted for the reflecting surface 12, in particular to obtain either a converging beam or a diverging beam, with the design of the corresponding respective cross-section for the reflecting surface 12 forming part of the normal competence of a person skilled in the art.

Once a bulb 1 of the invention emits a directional beam 16 when its filament 5 is electrically powered, and once the direction 17 of this beam is a function solely of the orientation of the bulb 1 about its axis 2, the use of bulbs of the invention is particularly advantageous in replacing conventional bulbs so as to provide strip lights with a non-limiting example being described below with reference to FIG. 4.

Figure 4:
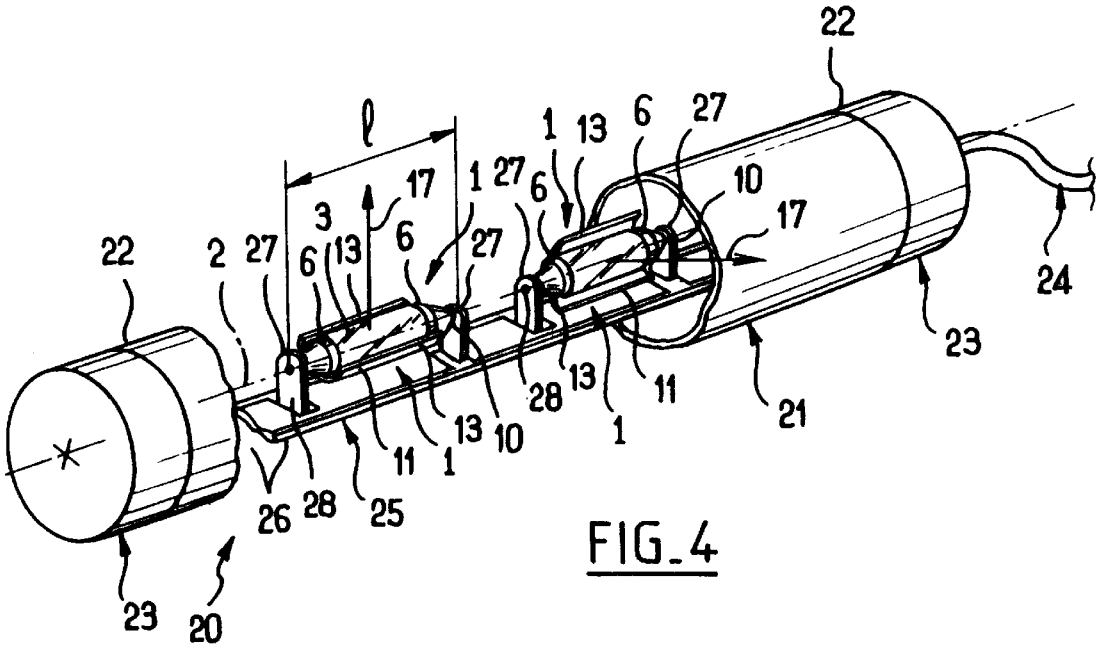
FIG. 4 is an exploded perspective view of a strip light of the invention, having a plurality of bulbs of the invention.

In conventional manner, the strip light 20 shown in FIG. 4 is designed to be fixed, for example, on a building front, a partition, or a wall of a piece of furniture by means that are not shown but that are well known to the person skilled in the art. It is elongate in shape along an axis which coincides with the axis 2 of the corresponding bulbs and which is consequently given numerical reference 2.

Particularly when designed for outside use, it advantageously has a transparent longitudinal tube 21, e.g. made of glass, which tube is circularly cylindrical on the inside and on the outside about the axis 2 and is suitable for being closed, at will, in leakproof manner at both of its longitudinal ends 22 by respective stoppers 23 which are engaged in removable manner so as to enable the tube 21 to be opened at will, in particular for the purpose of changing the bulbs 1 which are housed inside the tube 21; one of the stoppers 23 has a lead 24 passing through it for powering the bulbs 1 with electricity, generally at very low voltage, and in particular a voltage of less than 50 volts.

The tube 21 and its stoppers 23 are optional for strip light 20 for installing indoors.

Means that are not shown but that are known to the person skilled in the art serve inside the tube 21 to hold a longitudinal strip 25 in an orientation that is fixed about the axis 2 relative to the tube 21 and that is offset from said axis 2, extending from one of the stoppers 23 to the other.

This strip 25 is of conventional design, for example as taught in the Applicants° French patent No. 2 123 853, and is intended both to carry and to hold individually the bulbs 1 of the invention just like conventional bulbs in a position where they are in alignment on the axis 2, and to power them simultaneously with electricity.

To this end, and in conventional manner for various embodiments not described in detail herein, e.g. as taught by the above-mentioned French patent of the Applicants, the strip 25 is made essentially out of electrically insulating material and has two longitudinal tracks 26 that are electrically conductive but insulated from each other, each of which is connected via the lead 24 to a respective pole of an electricity power supply when the power supply is DC, or respectively to the live and neutral terminals of an AC power supply.

In a manner that is likewise known, e.g. from the above-mentioned French patent of the Applicants, each of these tracks 26 is electrically connected to a respective set of tongues 27 which, in each set, are provided in a number corresponding to the number of bulbs 1 of the invention or other bulbs and which alternate so that a tongue 27 corresponding to one of the tracks 26 is situated between two tongues 27 corresponding to the other track 26.

The tongues 27 extend transversely, any they project transversely from the same face of the strip 25 so as to intersect the axis 2 around which they present respective free end zones. They are suitable for bending elastically so that their respective end zones surrounding the axis 2 can be splayed apart or moved together by resilient bending along said axis 2.

More precisely, the tongues 27 connected respectively to the tracks 26 are associated in pairs of longitudinally adjacent tongues 27 one of which is connected to one of the tracks 26 and the other which is connected to the other track 26, and which are spaced apart longitudinally relative to each other in their free end zones surrounding the axis 2 by a distance l which resiliently tends to be slightly shorter than the length L of a bulb 1 measured between the tips 10 of its terminals 6 and standardized for "festoon"-type bulbs. In addition, on the axis 2, both tongues 27 in a pair are either pierced by respective holes 28 of diameter that is small relative to the diameter of the outer peripheral face 7 of the terminals 6, or else they are merely locally indented facing each other, so that by moving the free ends of the two tongues 27 in a pair resiliently apart from each other, it is possible to insert a bulb 1 between them until its axis 2 coincides with the axis 2 of the strip light 20, and then by releasing the tongues 27 they are caused to engage the tips 10 of the terminals 6 of the bulb 1 via their holes 28 (or the local indentations that replace them), thereby simultaneously holding the bulb on the axis of the strip 25 in a manner that is releasable by deliberating moving the tongues 27 apart, e.g. when a bulb 1 is to be changed, and also providing an electrical connection between each terminal 6 and a respective track 26.

Such a mount is conventional and it enables each bulb 1 to be oriented at will about the axis 2, which possibility is of no interest with a conventional bulb that does not have a mirror 11, but is taken advantage of by the invention to enable the direction 17 in which light is emitted by each bulb 1 when its filament 5 is electrically powered to be oriented at will about the axis 2 relative to the strip 25; the two tongues 27 associated with each bulb 1 provide sufficient longitudinal clamping on the terminal 6 of the bulb 1 to ensure that the orientation imparted deliberately to the bulb 1 while it is being installed is retained over time in spite of the unbalance that results from the presence of the mirror 11 in most orientations of the bulb 1.

Each bulb 1 of the invention can thus be oriented independently of the other bulbs 1 of the invention at will and without discontinuity over at least 180° for the direction 17 about the axis 2, providing the size of the mirror 11 between its edges 13 is made small enough to avoid coming into abutment against the strip 25 regardless of the orientation of the bulb 1 about the axis 2 relative to said strip 25; nevertheless, in most cases, it suffices for each bulb 1 to be capable of being oriented over less than 180°, with the only limit in this context being associated with one or other of the edges 13 of the mirror 11 coming into abutment against the strip 25.

Naturally, bulbs 1 of the invention can be interspersed with conventional bulbs that do not have a mirror on a common strip 25, and indeed a single strip 25 can equally well receive both bulbs 1 of the invention and conventional bulbs, thus making it possible to implement strip lights 20 of different characteristics using components that are the same, apart from the bulbs.

The person skilled in the art will readily understand that although the use of "festoon"-type bulbs for implementing the bulbs 1 of the invention is at present particularly preferred because of the wide range of orientations such bulbs can take up about their axes 2 when they are mounted on standard type strips 25 that are already in use for traditional "festoon"-type bulbs, the present invention is not limited as to the type of bulb concerned and the person skilled in the art will in each case be capable, without going beyond the ambit of the present invention, of providing an appropriate connection between a bulb 1 of the invention and the strip 25 to have various possible orientations available for each bulb 1 about the axis 2 relative to the strip 25, and preferably independently from one bulb 1 to another.

In general, the present invention is capable of numerous variants compared with the embodiments described above, without that going beyond the ambit of the invention.

What is claimed is:

1. An electric light bulb of the type presenting a longitudinal axis and having a longitudinal filament disposed at least approximately on said axis and suitable for emitting light when it is electrically powered, and a glass enclosing the filament and presenting around it at least for the most part an outer peripheral face that is at least approximately circularly cylindrical about the axis, the bulb being characterized in that it further comprises, outside the glass, a mirror having a concave reflecting surface which is placed locally in contact with the glass and via which the mirror is directly secured to the outer peripheral face of the glass, which reflecting surface is defined by longitudinal generator lines and presents a cross-section different from the cross-section of the outer peripheral face of the glass, which section is selected and disposed relative to the axis in such a manner that the reflecting surface is tangential to the outer peripheral face of the glass along a common longitudinal generator line, and relative to the filament in such a manner that the reflecting surface concentrates the light emitted by the filament when it is electrically powered into a beam of predetermined orientation and flare angle.

2. An electric light bulb according to claim 1, characterized in that the cross-section of the reflecting surface is parabolic and tangential to the cross-section of the outer peripheral face of the glass, in that its focus lies on the axis, and in that its directrix is situated at a distance from the axis that is equal to the outside diameter of the glass.

3. An electric light bulb according to claim 1, characterized in that the cross-section of the reflecting surface is circular and tangential to the cross-section of the outer peripheral face of the glass, in that its center is placed on the outer cross-section of the glass, and in that its radius is equal to the outside diameter of the glass.

4. An electric light bulb according to claim 1, characterized in that the cross-section of the reflecting surface is symmetrical about a plane containing the axis.

5. An electric light bulb according to claim 1, characterized in that the reflecting surface extends over an angle relative to the axis that is not greater than 180°, and that is preferably close to 180°.

6. An electric light bulb according to claim 1, characterized in that the mirror is stuck to the outer peripheral face of the glass via its reflecting surface by means of adhesive that is transparent or translucent.

7. An electric light bulb according to claim 1, characterized in that it is of the "festoon" type, being generally circularly symmetrical about the axis and having two axial electrical connection terminals for the filament, which terminals are at opposite ends of the bulb.

8. A strip light comprising a longitudinal support strip and a plurality of electric light bulbs of the type presenting a longitudinal axis and having a longitudinal filament disposed at least approximately on the axis and suitable for emitting light when powered electrically, and a glass enclosing the filament and presenting around it, at least for the most part, an outer peripheral face that is at least approximately circularly cylindrical about the axis, said bulbs being carried and held individually by said support strip to form a longitudinal alignment, the strip light being characterized in that at least one of said bulbs further includes, outside the glass, a mirror presenting a concave reflecting surface which is placed locally in contact with the glass and via which the mirror is directly secured to the outer peripheral face of the glass, which reflecting surface is defined by longitudinal generator lines and presents a cross-section different from the cross-section of the outer peripheral face of the glass, which section is selected and disposed relative to the axis in such a manner that the reflecting surface is tangential to the outer peripheral face of the glass along a common longitudinal generator line, and relative to the filament in such a manner that the reflecting surface concentrates the light emitted by the filament when it is electrically powered into a beam of predetermined orientation and flare angle.

9. A strip light according to claim 8, characterized in that the support strip is suitable for carrying and holding at least one of said bulbs individually in a plurality of orientations about its axis and selected independently of the orientation of the other bulbs about their axes.

10. A strip light according to claim 8, characterized in that it has a transparent longitudinal tube surrounding the bulbs and the support strip coaxially and suitable for being, at will, closed in leakproof manner or opened.

11. A strip light according to claim 8, characterized in that the cross-section of the reflecting surface is parabolic and tangential to the cross-section of the outer peripheral face of the glass, in that its focus is placed on the axis, and in that its directrix is situated at a distance from the axis that is equal to the outside diameter of the glass.

12. A strip light according to claim 8, characterized in that the cross-section of the reflecting surface is circular and tangential to the cross-section of the outer peripheral face of the glass, in that its center is placed on the outer cross-section of the glass, and in that its radius is equal to the outside diameter of the glass.

13. A strip light according to claim 8, characterized in that the cross-section of the reflecting surface is symmetrical about a plane containing the axis.

14. A strip light according to claim 8, characterized in that the reflecting surface extends an angle relative to the axis that is not greater than 180°, and that is preferably close to 180°.

15. A strip light according to claim 8, characterized in that the mirror is stuck to the outer peripheral face of the glass via its reflecting surface by means of adhesive that is transparent or translucent.

16. A strip light according to claim 8, characterized in that said at least one bulb is of the "festoon" type, being generally circularly symmetrical about the axis and having two axial electrical connection terminals for the filament, which terminals are at opposite ends of the bulb.

* * * * *